United States Patent [19]

Wu

[11] Patent Number: 4,644,119

[45] Date of Patent: Feb. 17, 1987

[54] REPETITIVE SWITCH FOR INDUCTIVELY DRIVEN ELECTROMAGNETIC LAUNCHERS

[75] Inventor: Jiing-Liang Wu, Murrysville, Pa.

[73] Assignee: Westinghouse Electric Corp., Pittsburgh, Pa.

[21] Appl. No.: 590,666

[22] Filed: Mar. 19, 1984

[51] Int. Cl.[4] ..... H01H 33/04; H01H 33/06

[52] U.S. Cl. ..... 200/144 R; 200/148 H; 200/150 C; 200/151; 89/8

[58] Field of Search ..... 200/150 C, 148 H, 144 R, 200/151

[56] References Cited

U.S. PATENT DOCUMENTS 4,369,692 1/1983 Kemeny ..... 89/8

4,426,562 1/1984 Kemeny ..... 200/151

*Primary Examiner*—Robert S. Macon

*Attorney, Agent, or Firm*—R. P. Lenart

[57] ABSTRACT

A rotary switch for switching large direct currents is provided with a rotating cylinder having a pair of electrically connected angularly spaced conductors. Retractable sliding contacts are provided to make contact with the rotor surface and an insulated slot arc chamber is provided to improve the rate of voltage rise when the switch opens. Two of these switches can be connected in parallel to provide a switching system for an electromagnetic projectile launcher wherein one switch conducts initial charging current to charge an inductive storage device then commutates that current to the second switch which subsequently commutates the current to the launcher load.

9 Claims, 7 Drawing Figures

REPETITIVE SWITCH FOR INDUCTIVELY DRIVEN ELECTROMAGNETIC LAUNCHERS

STATEMENT OF GOVERNMENT INTEREST

The United States Government has rights in this invention pursuant to Contract No. DAAK10-82-C-0277 between the Department of Defense and Westinghouse Electric Corporation.

BACKGROUND OF THE INVENTION

This invention relates to electric switches and more particularly to switches which are used to switch very large direct currents such as the currents required for electromagnetic projectile launching.

One type of well known electromagnetic projectile launcher includes a pair of parallel conductive rails, a sliding armature for conducting current between the rails and propelling a projectile along the rails, a source of direct current, and a switching system for directing current from the current source to the projectile launching rails. Current sources which employ an inductive energy storage element and a homopolar generator have demonstrated the capability of providing sufficient current to achieve an acceptable projectile acceleration. However, such inductively driven launcher systems require the service of an opening switch to accomplish the required power compression. The functions performed by the opening switch include: providing, in the closed position, a low resistance path for current flow during the charging of the inductive energy storage device; and commutating, within a short time interval of typically less than one millisecond, the current flow into the conductive rail load. In repetitive firing launcher systems, these functions must be performed in rapid succession.

Inductively driven electromagnetic launchers typically require peak current magnitudes on the order of several hundred thousand to several million amperes. To achieve these current magnitudes, the inductive energy storage device may have to be charged for a time on the order of several tens to several hundreds of milliseconds. This results in an accumulated $I^2t$ through the switching system during charging of about $10^{11}$ $A^2$-sec. per shot. To reduce resistive losses during inductor charging, the switch must be designed with minimum resistance. This generally requires sliding switch contacts with multiple contact points and massive current carrying conductors. The requirement of a massive moving contact presents difficulty in the construction of a switch to perform the current commutation function in which a fast rise of switch voltage is required. Such a fast rise in switch voltage generally can be obtained by parting the switch contacts at high speed, which for massive moving contacts demands large and powerful switch actuating mechanisms.

For a single shot launcher application, a linear parallel conductor switch mechanism such as the switch disclosed in U.S. Pat. No. 4,369,692, issued Jan. 25, 1983 to Kemeny, can successfully provide the switching function. However, such a switch cannot provide rapid repetitive operation. U.S. Pat. No. 4,426,562, issued Jan. 17, 1984 to Kemeny discloses a rotary switch design using a rotor as a bridging contact to make and break with stationary switch terminals. The stationary switch terminals are electrically insulated from each other and constitute a part of the switch housing. With proper timing of the rotor rotation, the switch can provide a low resistance current path for inductor charging and can subsequently break contact to generate two arcs in series to initiate current commutation. To develop the required contact opening speed, rapid acceleration of the switch rotor is required.

The extremely high value of accumulated $I^2t$ duty placed upon the switch during inductor charging requires massive moving contacts to minimize the resistive loss. A massive moving contact, however, presents difficulties in achieving acceptable contact opening speed needed to perform the fast current commutation into the load. Although this problem may be overcome by accelerating the moving contact well ahead of the initiation of current commutation, the required contact engagement length and/or the kinetic energy consumed in accelerating the moving contact can be unacceptably large. Keeping the massive moving contact at constant linear or rotating speed is not an acceptable solution since this would require a contact engagement length on the order of a few meters to provide a current conducting path during the inductor charging.

SUMMARY OF THE INVENTION

The present invention provides a switching system which eliminates the need for rapid acceleration of a rotating switch conductor and can be incorporated into a multiple switch system which easily provides the required inductor charging function and rapid current commutation into the load. A switch constructed in accordance with this invention comprises: a cylindrical rotor having first and second electrically connected conducting elements extending arcuately over two angularly displaced portions of the cylindrical surface of the rotor and axially therealong; at least two angularly spaced retractable brush members extending radially inward toward and axially along the cylindrical surface of the rotor for making sliding electrical contact with the surface of the rotor when the brush members are in a first position; fixed insulating members extending between the brush members for electrically isolating the brush members from each other; and means for rotating the rotor. The brush members and conducting elements are dimensioned and positioned such that when the rotor is in a first position, applied current flows from one of the brush members through the conducting elements of the rotor to the other brush member and when the rotor is rotated to a second position, the conducting elements no longer make contact with both of the brush members, thereby interrupting the flow of current from one brush member to the other. Fixed insulating members on the rotor surface and between the brush members define an arc chamber to contain an arc which is drawn upon the breaking of contact between the brush member and the conducting elements on the rotor. The arc chamber extends angularly around the rotor from a point adjacent to the brush members in the direction of rotation of the rotor.

When used in an electromagnetic launcher application, two of these rotors can be electrically connected in parallel and operated at different rotor speeds and with different relative angular rotor positions such that applied current initially flows through the conducting elements of a first one of the rotors, electrical continuity is then established between the brush members of the second rotor while current continues to flow through the first rotor, the conducting element of the first rotor subsequently breaks contact with its associated brush members, thereby transferring current to the second rotor, and the conducting element of the second rotor then breaks contact with its associated brush members to commutate current into the load.

DESCRIPTION OF THE PREFERRED EMBODIMENT

Figure 1:
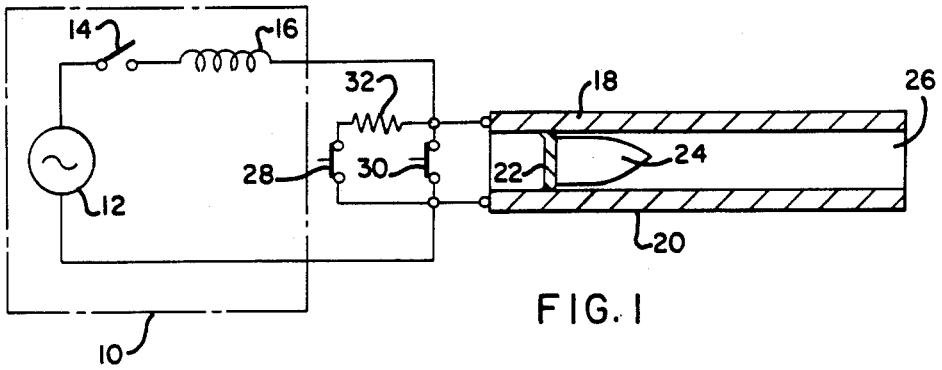
FIG. 1 is a schematic diagram of an electromagnetic projectile launching system employing a switching system in accordance with one embodiment of the present invention.

Referring to the drawings, FIG. 1 is a schematic diagram of an electromagnetic projectile launching system constructed in accordance with one embodiment of the present invention. In this system, a source of direct current 10 comprising the series connection of generator 12, switch 14 and inductive energy storage device 16 is connected to the breech end of a pair of generally parallel conductive projectile launching rails 18 and 20. A sliding conductive armature 22 serves as means for conducting current between the rails and for propelling a projectile 24 along a bore 26 between the rails. A pair of switches 28 and 30 are electrically connected in parallel with each other and also connected across the breech ends of conductive rails 18 and 20. A small resistance 32 is inserted in series with switch 28.

To launch a projectile, switches 14 and 30 are initially closed to provide a path for current which charges inductive storage device 16. When this current approaches a predetermined magnitude, switch 28 is closed and switch 30 is subsequently opened thereby transferring the charging current to switch 28. Switch 28 subsequently opens rapidly to commutate current into the load which comprises the projectile launching rails 18 and 20 and the armature 22.

Figure 2:
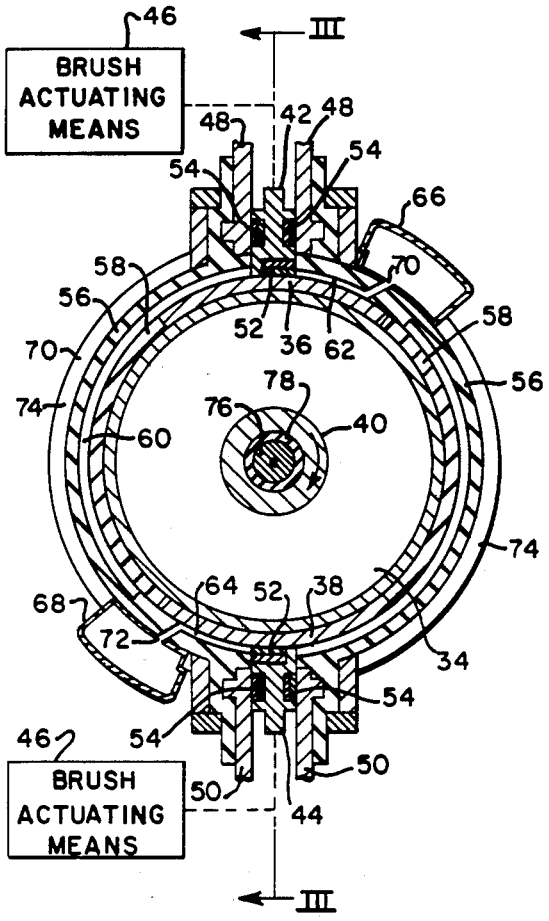
FIG. 2 is a cross section of a switch constructed in accordance with one embodiment of the present invention, taken along line II—II of FIG. 3.

FIG. 2 is a cross section of a switch constructed in accordance with one embodiment of the present invention which is suitable for use in the launching system of FIG. 1. This switch includes a cylindrical rotor 34 having first and second conducting elements 36 and 38 which are electrically connected together through conductor 40. Conducting elements 36 and 38 are angularly displaced around the cylindrical surface of the rotor and extend axially therealong. Two angularly spaced retractable brush members 42 and 44 are mounted to extend radially inward toward and axially along the cylindrical surface of the rotor for making sliding electrical contact with the rotor surface when held in a first position as shown. A separate brush actuating means 46 is used to retract the brushes thereby preventing contact between the brushes and the rotor conducting elements 36 and 38. Brushes 42 and 44 are slidably disposed between conductors 48 and 50 respectively. Each brush includes a first plurality of resilient contact members 52 disposed along the radially inward surface of the brush to make sliding electrical contact with the conducting elements of the rotor. Additional groups of resilient contact members 54 are positioned along the sides of brush members 42 and 44 to provide sliding electrical contact with the associated conductors 48 and 50. Fixed insulating members 56 extend between the brush members to electrically isolate them from each other. Similarly, fixed insulating member 58 extend along the surface of rotor 34 to provide a break in the surface continuity of conducting elements 36 and 38. An annular gap 60 is formed between insulating members 56 and the surface of rotor 34. Portions of this gap 62 and 64 serve as arc chambers to contain and cool the arcs generated as the rotor conducting elements break contact with the brush members. The radial cross-section of these arcing chambers has a rectangular slot geometry to maximize the surface cooling area of the arc. A pair of external arc chambers 66 and 68 are connected to arc chambers 62 and 64 by openings 70 and 72 respectively in insulating member 56. A switch housing 74, which may be a grounded metallic structure serves to contain the switch elements.

Figure 3:
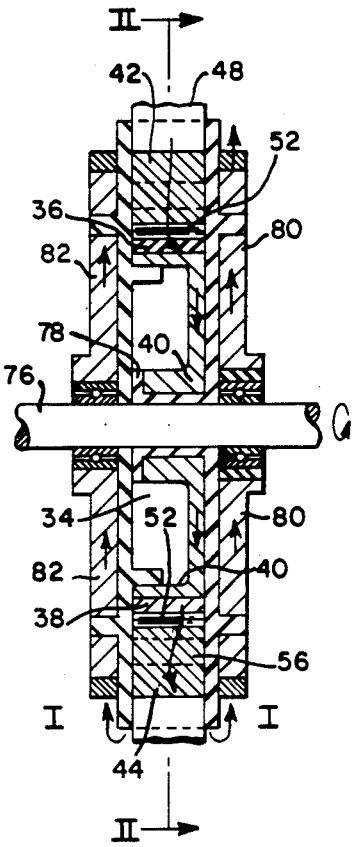
FIG. 3 is a cross section of the switch of FIG. 2 taken along line III—III.

FIG. 3 is a cross section of the switch of FIG. 2 taken along line III—III. In this drawing, the rotor 34 is seen to be mounted for rotation around shaft 76. Insulation 78 is inserted between the rotor and the shaft. When brush members 42 and 44 make contact with conducting elements 36 and 38, current flows as indicated by the arrows I. Conducting structures 80 and 82 can be used as shown to provide the return path for the current. If currents of up to, for example, 100 kiloamps are used, then the inductance of the switch structure can be minimized by only utilizing conducting structure 80 for the return path. If larger currents are involved, then both conducting structures 80 and 82 can be utilized. In an alternative embodiment, external bus bars, which may be extensions of conductors 48 and 50, can be used so that neither conducting structure 80 nor 82 is required.

Figure 3A:
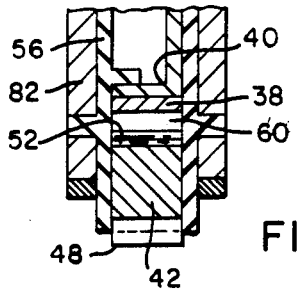
FIG. 3A is a portion of the cross section of FIG. 3 showing the switch in an open position.

FIG. 3A is a portion of the cross section of FIG. 3 showing the switch in an open position.

Figure 4:
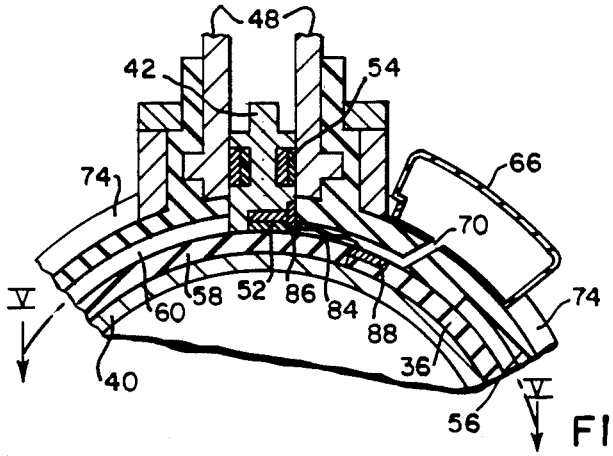
FIG. 4 is an enlarged view of a portion of FIG. 2.
Figure 5:
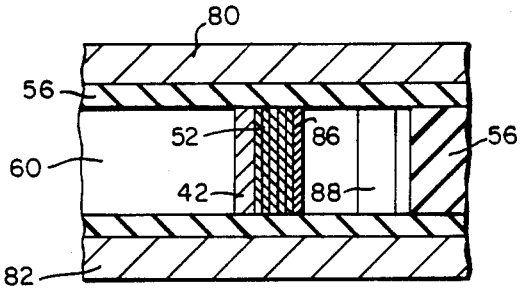
FIG. 5 is a partial cross section of FIG. 4 taken along line V—V.

FIG. 4 is an enlarged portion of the brush member contact region of FIG. 2 illustrating an arc 84 being drawn between arc resistant portions 86 and 88 of brush member 42 and conducting element 36 respectively. FIG. 5 is a cross section of a portion of FIG. 4 taken along line V—V.

To further illustrate the invention, the operation of the launching system of FIG. 1 will now be described. For discussion purposes, the first switch 30 in FIG. 1 is designated as the slow switch and the second switch 28 is designated as the fast switch. In operation, the slow switch initially closes and remains in the closed position until the charging of the inductive storage element is completed. Then the slow switch opens and commutates current into the fast switch which, after a very short period of current flow, opens and commutates current into the load. To prevent appreciable current flow through the fast switch during the inductor charging period, a low resistive load, on the order of for example tens of micro ohms, may be added in series with the fast switch as shown in FIG. 1.

Although this switching scheme requires an additional current commutation process, from the slow switch to the fast switch, the time allowed for completing this process can be as long as several milliseconds, compared to less than one millisecond for commutation into the load. This longer current commutation time permits a more slowly rising switch voltage and a lower peak voltage on the slow switch. The additional current commutation process can therefore be achieved by a switch having a much slower contact opening speed.

To perform the assigned functions, the slow switch would be designed with massive moving contacts which are either moving at constant but slow rotating speed during the entire switching operation or are stationary during inductor charging and then accelerated to a slow contact opening speed. The preferred design of the fast switch would include a light weight contact rotating at constant high speed during the switching operation. The rotating speed and phase angle of the fast switch would necessarily be coordinated with the motion of the moving contact of the slow switch to achieve the proper switch timing sequence.

It should be apparent that the switching scheme of this invention permits both the switching duties in the period of inductor charging and during current commutation into the load to be satisfied with optimum switch designs and without compromising the performance or requiring high energy comsumption for switch operation. The parallel switching system also provides operational versatility in that variations of switching parameters such as inductor charging time or current commutation time can be relatively easily accomplished.

The switch embodiment illustrated in FIGS. 2–5 is particularly suitable for use in the parallel switching scheme in that it is capable of repetitive operation and the rotor can be accelerated freely to the desired operating speed prior to contact engagement. The switch conducting time and phase can be precisely controlled by the rotor segment design and rotor speed. In addition, the timing of contact making between the sliding contacts and the rotor surface has no influence on the conducting time and phase as long as the contact making point lies within the insulating segment of the rotor circumference. Additional control is provided by the sliding contact which can place the switch in the electrically open position even though the conducting segment of the rotor is in phase with the sliding contact. The required fast rising of the switching arc voltage is enhanced by arc confinement in the arc chamber formed between the rotor and the adjacent insulating member. Arc products can be exhausted into the external arc containment chamber for reduction of wall ablation and pressure build up within the internal arc chamber. The air gap between the inner surface of the switch housing and the rotor surface serves to increase the dielectric withstand capability of the switch in the open position.

To illustrate the application of the rotary switch in the described switching scheme, an example electromagnetic launcher system is described.

Figure 6:
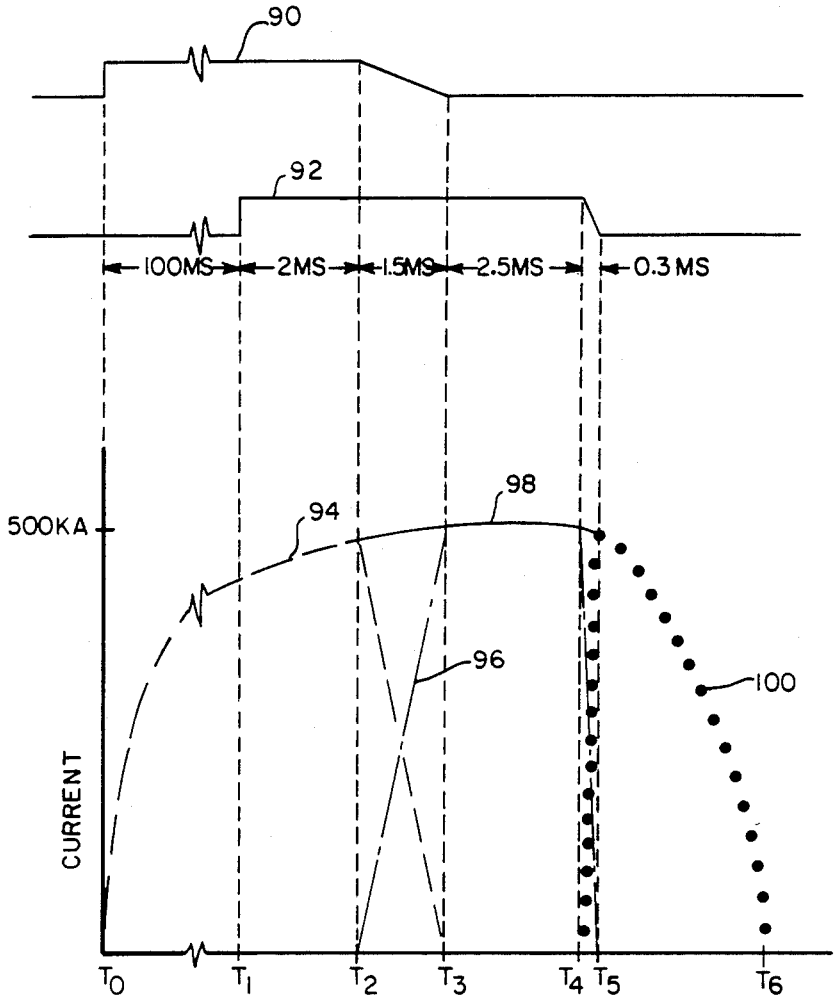
FIG. 6 is a series of waveforms which describe the operation of the switching system of FIG. 1.

The assumed parameters are:

Peak current: 500 kA
Inductor charging time: 100 ms
Projectile muzzle velocity: 3 km/s
Firing rate: 5 Hz
Current commutation time (to launcher barrel): 0.3 ms The resultant rotary switch designs have the following statistics:

Fast switch
Rotary diameter: 15.75 inches
Rotating Frequency: 2400 rpm
Axial length of rotor: 2.5 inches
Angular extent of rotor conducting segment: 83°
Angular extent of rotor insulating segment: 97°
Radial cross-section of internal arcing chamber: 0.25 inches × 2.5 inches Slow Switch
Rotor diameter: 15.75 inches
Rotating frequency: 150 rpm
Axial length of rotor: 2.5 inches
Angular extent of rotor conducting segment: 126°
Angular extent of rotor insulating segment: 54°
Radial cross-section of internal arcing chamber: 0.25–2.5 inches The operating sequence of the switches of this example is illustrated by the waveforms of FIG. 6. Waveforms 90 and 92 represent the operations of the slow and fast switch respectively with the high values of the waveform indicating the closed position. The dashed waveform 94 illustrates current flow through the slow switch while the dot-dash waveform 96 illustrates current flow through the fast switch. Total inductor current flow which equals the sum of the switch and load currents is illustrated by the dashed curve 94 from time $T_0$ to time $T_2$, the solid curve 98, and the load current as represented by the dotted waveform 100. At time $T_0$, the slow switch closes and allows the inductive storage element to be charged by the power supply. At approximately 100 milliseconds after current flow has started, the fast switch is closed. Two milliseconds later, current commutation from the slow switch to the fast switch is initiated when the slow switch opens. This current commutation is designed to be completed within 1.5 milliseconds. Two and one-half milliseconds after that commutation, the fast switch opens and commutates current, in 0.3 milliseconds, into the launcher load and initates the projectile firing.

Assuming an overall switch resistance of 5 micro ohms for both switches, an armature resistance of 100 micro ohms, a commutating inductance of 0.1 microhenry for both current commutating loops and negligibly small bus bar resistance, the switch voltage requirement during commutation can be estimated. The peak switch voltage required for the slow switch would be quite moderate at about 60 volts. This voltage can be obtained with low contact opening speeds of approximately 3.14 meters per second. Commutation from the fast switch to the load involves higher switch voltage requirements. Using a theoretical arc model which has been supported by experimental data, the peak switch voltage requirement for the fast switch can be estimated to be about 300 volts. This peak voltage can be achieved with a given rotor diameter and rotating frequency by a contact opening speed of about 50 meters per second. Although the given design example is for a firing current of 500 kA at a 5 Hz firing rate, higher current capacity can be readily achieved by proportionally increasing the axial rotor length. Increased firing rate can be accomplished by increasing the rotating speed of the slow switch.

To perform the switching scheme of this invention the switch of FIGS. 2–5 is initally in the idle position wherein the sliding contacts are withdrawn from making contact with the rotor circumference and the rotor is freely accelerated to the desired operating speed. The air gap between the rotor and the housing insulating member 56, which may be for example 0.5 inch, except at the arcing regions where a smaller gap may be preferred, provides dielectric isolation and allows additional control of switch operation. When current flow is to be initiated, the sliding contacts are actuated, for example mechanically or pneumatically, to make contact with the rotor circumference. The current conducting time is controlled by the length of the conducting segments and the rotor speed. As the current conducting phase is completed and the insulating segments on the rotor circumference advance to make contact with the brush members, and two arcs, one for each terminal, are drawn and confined in the arcing chamber between the rotor and the housing insulating member having a narrow slot geometry. This causes the arc voltage generated to rise very rapidly and accomplish the current commutation within the designated time because of the arc confinement and the high contact opening speed available. Arc products are exhausted into the external arc chambers to reduce ablation of the internal arc chamber wall and to limit pressure surges within the internal arc chamber. After current commutation, the sliding contact can be withdrawn or left in contact with the rotor circumference depending on the system requirements. It should be understood that the rotor diameter and rotating speed can be selected to yield the desired contact opening speed and switch voltage to suit the application.

Although the present invention has been described in terms of what is at present believed to be its preferred embodiment, it will be apparent to those skilled in the art that various changes may be made without departing from the scope of the invention. It is therefore intended that the appended claims cover all such changes.

What is claimed is:

1. A switch for switching direct currents comprising:

a cylindrical rotor having first and second electrically connected conducting elements extending arcuately over two angularly displaced portions of the cylindrical surface of the rotor and axially therealong;

at least two angularly spaced retractable brush members extending radially inward toward and axially along the cylindrical surface of the rotor for making sliding electrical contact with the surface of the rotor when said brush members are in a first position;

fixed insulating members extending between the brush members for electrically isolating the brush members from each other; and means for rotating said rotor;

said brush members and said conducting elements being so dimensioned and angularly positioned such that with said rotor in a first position, applied current flows from one of said brush members through said conducting elements to a second one of said brush members, and with said rotor rotated to a second position, said conducting elements no longer make contact with both of said brush members, thereby interrupting the flow of current from said one brush member to the other through said conducting elements, with said fixed insulating member and said rotor surface defining an internal arc chamber for an arc which is drawn upon the interruption of current flow, said arc chamber extending angularly around said rotor from one of said brush members in the direction that said rotor rotates in going from said first to said second positions.

2. A switch as recited in claim 1, wherein each of said retractable brush members comprises:

a first set of resilient contact elements extending from a radially inward surface of each brush member for making electrical contact with said rotor conducting elements; and a second set of resilient contact elements extending tangentially from each brush member for making sliding electrical contact with an adjacent bus bar.

3. A switch as recited in claim 1, wherein said insulating members form a generally cylindrical opening for receiving said rotor, such that a generally annular gap is formed between the rotor and the insulating members, a portion of said gap defining said internal arc chamber.

4. A switch as recited in claim 3, further comprising:

an external arc chamber connected to said internal arc chamber through an opening in one of said insulating members.

5. A switching system for switching direct currents, comprising:

two cylindrical rotors each having first and second electrically connected conducting elements extending arcuately over two angularly displaced portions of the cylindrical surface of each rotor and axially therealong;

at least two angularly spaced retractable brush members extending radially inward toward and axially along the cylindrical surface of each of the rotors for making sliding electrical contact with the surface of the associated rotor when said brush members are in a first position, wherein corresponding brush members associated with each rotor are electrically connected in parallel;

fixed insulating members extending between the brush members associated with each rotor, for electrically isolating the brush members from each other;

said brush members and said conducting elements being so dimensioned and angularly positioned such that with each of said rotors in a first position, applied current flows from one of said brush members through said conducting elements of the associated rotor, to a second one of said brush members, and with each of said rotors rotated to a second position, said conducting elements no longer make contact with both the associated brush members thereby interrupting the flow of current from said one brush member to the other through the conducting elements of the associated rotor, with said fixed insulating members defining an arc chamber adjacent to each rotor, for an arc which is drawn upon the interruption of current flow, said arc chamber extending angularly around each rotor from one of said brush members in the direction that each rotor rotates in going from said first to said second positions; and means for rotating said rotors at different speeds and with different relative angular positions such that applied current initially flows through the conducting elements of a first one of said rotors, electrical continuity is established between the brush members associated with a second one of said rotors while current continues to flow through the conducting elements of the first rotor, the conducting elements of the first rotor subsequently break contact with their associated brush members, thereby transferring current to said second rotor and the conducting elements of the second rotor subsequently breaks contact with their associated brush members.

6. A switching system as recited in claim 5, wherein each of said retractable brush members comprises:

a first set of resilient contact elements extending from a radially inward surface of each brush member for making electrical contact with the conducting elements of the associated rotor; and a second set of resilient contact elements extending tangentially from each brush member for making sliding electrical contact with an adjacent bus bar.

7. A switching system as recited in claim 5, wherein the rotational speed of the second rotor is greater than the rotational speed of the first rotor.

8. A switching system as recited in claim 5, further comprising:

a resistive element electrically connected in series with the brush members associated with said second rotor.

9. A switching system as recited in claim 5, further comprising:

two switch housings, each having a generally cylindrical opening being lined by said insulating members, for receiving one of said rotors, such that a generally annular gap is formed between said insulating members and the associated rotor.

* * * * *